United States Patent [19]

Jankowski

[11] Patent Number: 4,828,485

[45] Date of Patent: May 9, 1989

[54] FIREPLACE BURNER APPARATUS WITH EMBERIZING STRUCTURE

[75] Inventor: Vincent P. Jankowski, San Gabriel, Calif.

[73] Assignee: R. H. Peterson Co., City of Industry, Calif.

[21] Appl. No.: 182,437

[22] Filed: Apr. 18, 1988

[51] Int. Cl.[4] ..... F23Q 2/32

[52] U.S. Cl. ..... 431/125; 126/92 R; 126/512

[58] Field of Search ..... 126/92 R, 92 AC, 92 B, 126/92 C, 127, 152 B, 164; 431/125, 110, 112

[56] References Cited

U.S. PATENT DOCUMENTS

| | | | |
|---|---|---|---|
| D. 224,535 | 8/1972 | Whitehead | D23/167 |
| 3,362,395 | 1/1968 | Peterson | 126/92 R |
| 3,382,861 | 5/1968 | Peterson | 126/92 R |
| 3,543,741 | 12/1970 | Whitehead | 126/92 R |
| 3,582,250 | 6/1971 | Chatfield | 126/164 |
| 3,671,175 | 6/1972 | Campbell | 126/127 |
| 3,696,801 | 10/1972 | Whitehead | 126/92 R |
| 3,905,351 | 9/1975 | Hatfield et al. | 126/164 |
| 4,000,732 | 1/1977 | White | 126/92 R |

*Primary Examiner*—Samuel Scott
*Assistant Examiner*—Noah Kamen
*Attorney, Agent, or Firm*—William W. Haefliger

[57] ABSTRACT

A fireplace gas burner apparatus includes a posted gas burner pipe and structure defining flame chute at one side of the pipe plus a tray for emberizing material in the lateral path of flames from the flame chute, a log being supported to extend above the lateral path of flames directed toward the emberizing material. A flame interceptor may be utilized above the pipe.

10 Claims, 3 Drawing Sheets

FIREPLACE BURNER APPARATUS WITH EMBERIZING STRUCTURE

BACKGROUND OF THE INVENTION

The present invention relates to gas burners in general and more particularly to an artificial fireplace burner adapted to cooperate with artificial hearth logs in simulating a real log fire.

The fireplace with its log fire is generally accepted as a desirable part of the home.

In an effort to obtain the accepted pleasures and advantages of a real log fire without its attendant disadvantages, attention has been given to artificial fires making use of gas burners and artificial logs. Such artificial fires eliminate certain of the undesirable problems characteristic of the real fire but also lacked its realistic attributes in that, for example, yellow sheets of flame were missing, and there were no glowing ashes. There is need for an artificial burner apparatus which enhances yellow flame creation and distribution, and which also creates the appearance of glowing embers or ashes. U.S. Pat. No. 3,042,109 provides a means for dividing flames above a burner; however, it lacks any means to create the effect of glowing embers.

SUMMARY OF THE INVENTION

It is a major object of the invention to provide an artificial burner apparatus that meets the above need. That apparatus, in accordance with the invention, includes:

(a) a combustible gas burner pipe extending in a sideward direction and having ports to discharge gas in a forward direction for combustion to produce flames in a forwardly extending flame zone, (b) structure associated with the pipe, including flame chute means that extends forwardly immediately beneath the forwardly extending flame zone, (c) and that structure also including tray means that extends forwardly to support emberizing material in the paths of flames forwardly of the flame chute means, such material then being heated to glow just below the position of an artificial log or logs located above the flame chute means to be bathed in rising yellow flames.

As will be seen, the tray means typically includes a metallic tray that extends forwardly immediately beneath one or more metallic flame chutes, and those chutes and the tray attached to the burner pipe so as to be directed in relation to that pipe when the pipe is installed on a grate in a fireplace.

It is a further object to provide emberizing material on the tray, proximate a forward edge or lip of the tray, that material being comminuted and adapted to readily glow when flames impinge upon it. Of great advantage for this purpose is a mixture of rock wool and vermiculite.

These and other objects and advantages of the invention, as well as the details of an illustrative embodiment, will be more fully understood from the following specification and drawings, in which:

DRAWING DESCRIPTION

DETAILED DESCRIPTION

Figure 1:
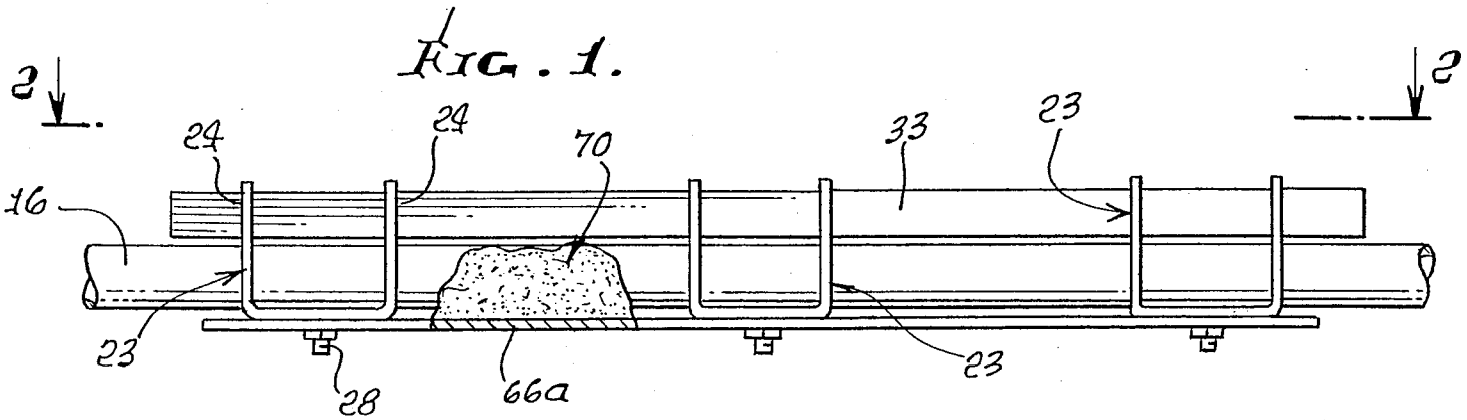
FIG. 1 is an elevation looking in a forward direction, and showing apparatus embodying the invention.
Figure 5:
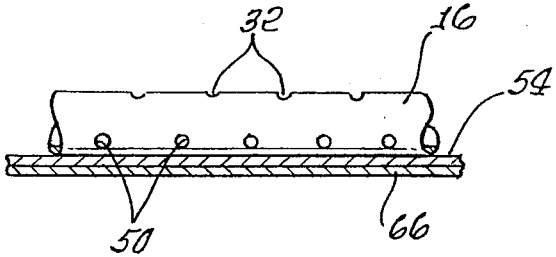
FIG. 5 is a fragmentary elevation on lines 5—5 of FIG. 3.
Figure 6:
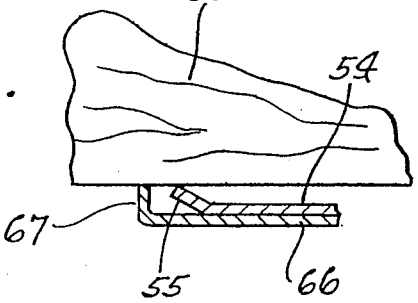
FIG. 6 is a fragmentary section on lines 6—6 of FIG. 2.
Figure 4:
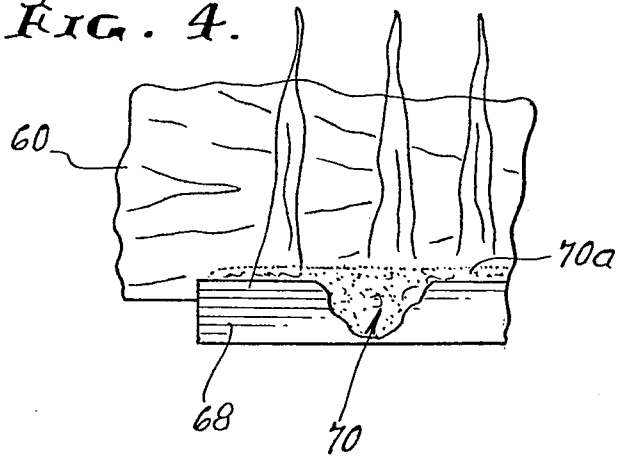
FIG. 4 is a fragmentary frontal elevation.

As illustrated, grate 11 is suitably supported above the floor of the fireplace upon spaced legs 12. The grate includes parallel spaced bars 15 permitting free flow of air, upwardly between the bars. Other types of grates may be used. See also bars 15*a*.

The burner pipe 16 extends across and above the bars 15 and comprises a hollow metallic pipe or conduit capped at one end 17 and connected at its opposite end to pipe 18, which is itself connected to a manually controlled valve 19 in the line of an inlet pipe 21.

Pipe 16 extends longitudinally sidewardly (relative to the front of a fireplace) along the grate 11 and is supported above it by means of spaced U-shaped brackets 23, the opposite ends 24 of which are turned upwardly and formed with openings 26 sized closely to enclose the pipe. The base 23*a* of each bracket 23 between its ends 24 is slotted at 27 and receives a threaded bolt 28, the shank of which extends through slot 27, That bolt may attach to a clamp to clamp the pipe to the grate, if desired.

Positioned immediately above pipe 16, which is formed along its upper surface with spaced burner ports 32 is a metallic flame interceptor 33. In the form illustrated, element 33 is V-sectioned with its angle or apex directed downwardly, but it is to be understood that it may have other shapes so long as it is positioned centrally above pipe 16 and is in alignment with the ports 32. Interceptor 33 is positioned by the brackets 23, the legs 24*a* of which are V-shaped near their upper ends to seat the interceptor, and the upper ends 24*b* of which extend over the interceptor 33 to prevent upward displacement of the interceptor and to hold it against the V-seats formed by the legs 24*a*.

Figure 8:
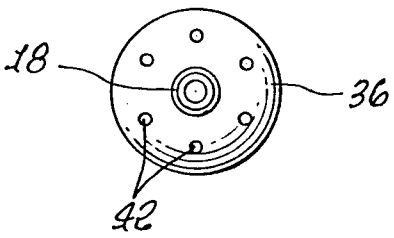
FIG. 8 is a section on lines 8—8 of FIG. 7.
Figure 7:
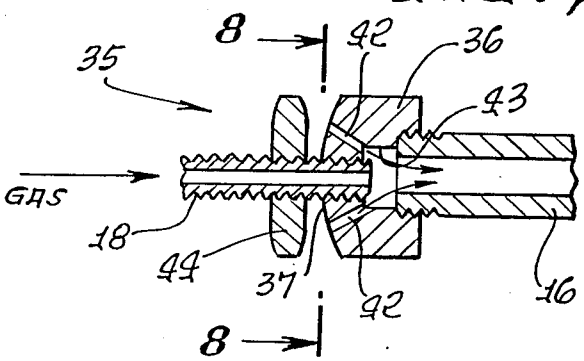
FIG. 7 is a side elevation showing a flame control unit.

The flow of gas to the burner pipe 16 is under the control of the common valve 19 in the inlet line but the mixture of gas and air and the resulting color of the flame are controlled by an adjustment generally indicated by the reference character 35, as seen in FIGS. 7 and 8.

An air injector 36 is formed with a plurality of circularly arranged air openings 42 about the central conduit or port 43 through which the entering gas passes on its way from the pipe 18 into the burner pipe 16. An injector action takes place, in that upon the flow of gas into pipe 16 from reduced conduit 18, air is drawn into the pipe 16 through openings 42. The volume of air entering is controlled by the adjustment of a flat-sided interiorly threaded nut member 44, shown in FIG. 7, which is adapted to be spaced closely adjacent, in contact with, or spaced from the convex end 37 of injector 36, to close to varying degrees the openings 42.

In accordance with the invention, the burner pipe has ports 50 extending along the lower frontward side thereof to pass combustible gas out of the pipe and in a forward direction (see arrow 51) for combustion, producing flames in a forwardly extending flame zone 52.

Structure is associated with the pipe including flame chute means that extends forwardly immediately beneath the forwardly extending flame zone; said structure also includes tray means that extends forwardly to support emberizing material in the path of flames forwardly of the flame chute means, thereby to glow in response to flame impingement on the emberizing material; and said structure provides means to support log means above the flame chute means, rearwardly of and above the level of the emberizing material, so that flames rise at the forward side of the log means, and above the emberizing material.

In the example, the structure may include the flame chutes 54, each of which is integral with the base 23*a* of one of the brackets 23.

Figure 2:
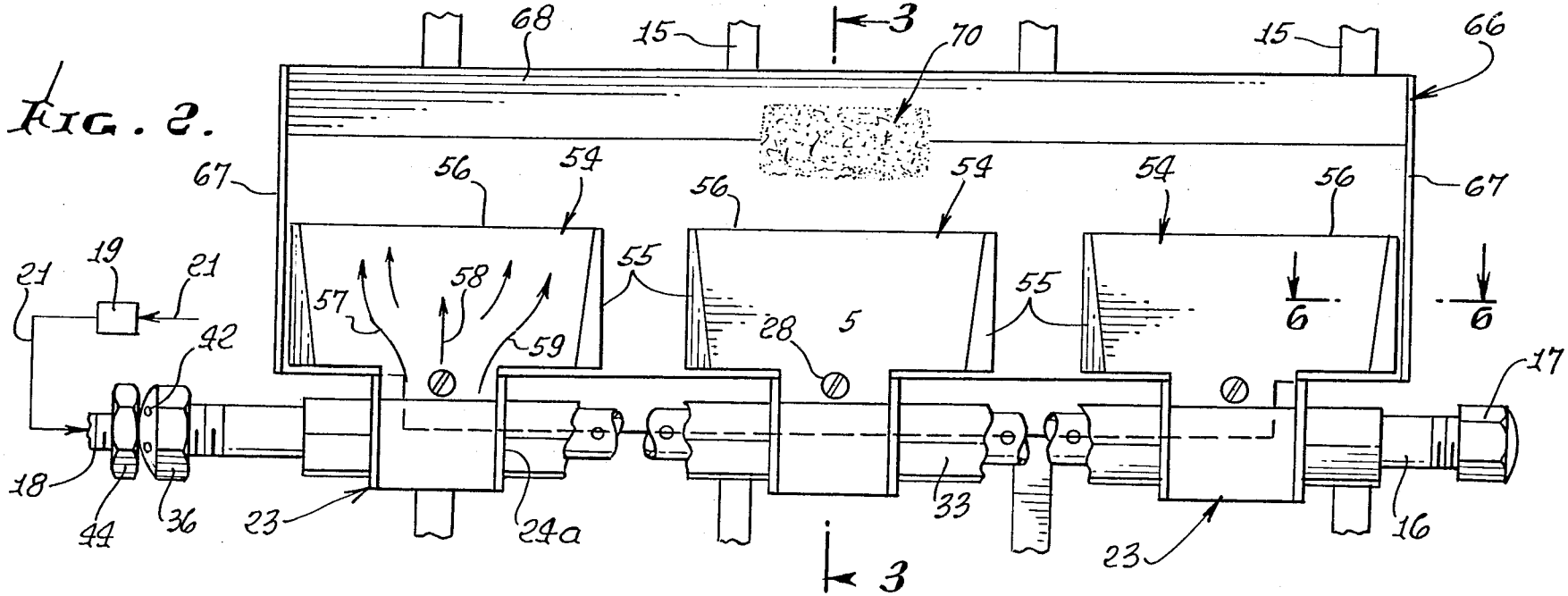
FIG. 2 is a plan view on lines 2—2 of FIG. 1.

The chute comprises a metal sheet which is generally rectangular, having turned up side flanges 55, and a front edge 56. The chute extends horizontally forwardly. Flames travel or flow forwardly over the top surface of the chute, in directions indicated by arrows 57–59 in FIG. 2. The chute also functions to prevent up-drafts of air from causing up-welling of flames before they travel forwardly across front edges 56. An artificial log 60 is seated at 61 on the chute flanges 55, so that flames travel beneath that log. Another log 63 is seated at 64 on the grate bars, rearwardly of the gas pipe position. If desired, the gas pipe and chutes may be relatively shifted about on the grid bars, to desired position, i.e. it remains unclamped to the bars.

The tray means associated with the pipe may take the form of metal sheet tray 66 which is generally rectangular, and has side edges 67, and a forward edge flange 68, extending longitudinally parallel to the 20 burner pipe 16, and spaced forwardly thereof. It has tongues or extents 66*a* extending generally beneath the brackets, and is also clamped by bolts 28 to the undersides of the flame chutes. The tray projects forwardly beyond the forward edges 56 of the chutes, so that edge flange 68 is spaced forwardly of edges 56.

Emberizing material 70 which is typically comminuted, is placed in the tray, in a longitudinally extending pile 70*a*, adjacent the edge flange 68, as shown. Such material most advantageously consists of a mixture of rock wool and vermiculite, although other materials are usable.

In operation, some flames 71 traveling over and beyond the chutes, travel toward and into the emberizing material, causing it to glow and shimmer in a manner very much similar to the glowing of wood ashes that result from burning of a wooden log. Other flames traveling forwardly of the chutes rise and play over the front side of the artificial log, as indicated at 75 in FIG. 3. Such rising flames are typically realistically yellow due to their travel over the chute means and tray.

Figure 3:
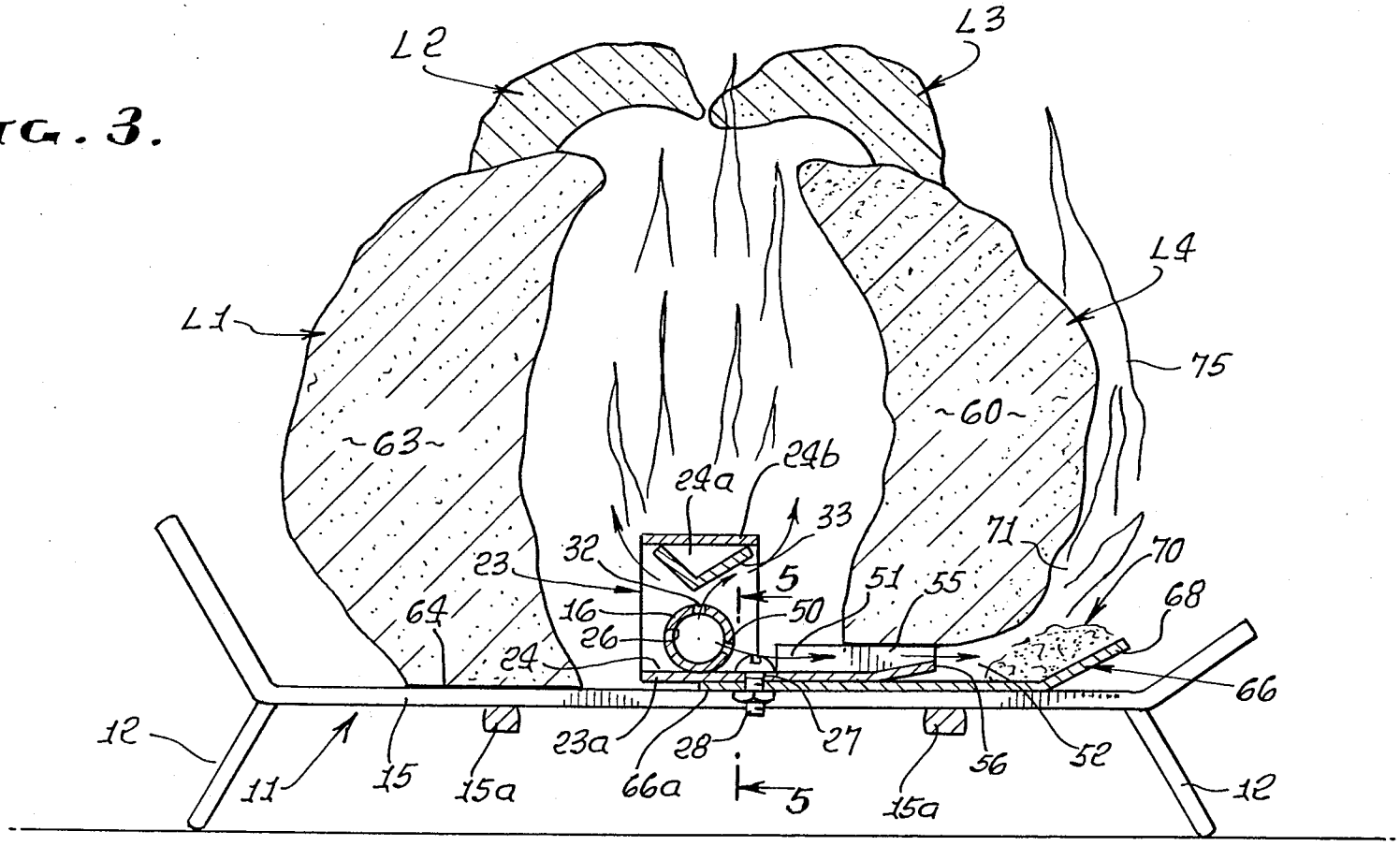
FIG. 3 is an enlarged section on lines 3—3 of FIG. 2.

Also, the burner being positioned on the grate 11 and the logs, are then positioned as shown. These logs, bearing the reference characters L1, L2, L3 and L4, are artificial logs and are centrally hollowed out as to give the appearance of being partially burned. They are preferably arranged with the larger logs L1 and L4 spaced in grate 11 upon opposite sides of the burner unit, as shown in FIG. 3, and with smaller logs L3 and L2 extended angularly thereacross as to leave openings for the emergence of the flames. The exact arrangement and number of logs is not of the essence and the described arrangement is only illustrative.

With the burner unit and the logs positioned in the grate, the operator opens the valve 19 to permit the flow of gas into the burner pipe 16 from which it emerges through the upper ports 32 and, upon being combusted, creates a flame which is immediately divided by the interceptor 33 into two spaced parallel sheets 80 and 81 of flames upon its opposite sides. These flames rise upwardly and upon contacting the transversely angularly extending upper logs L3 and L2 emerge therebetween and therearound, in a manner having no particular prearranged design but which greatly resembles a real fire.

The color of the flame also depends upon the mixture of the gas and air and this is controlled by the operator through adjustment of the injector adjustment nut 44. By adjusting that nut, by threading it on the reduced portion 38 of injector 36 toward the air ports 42, the volume of air drawn into the burner pipe 16 is reduced and with this reduction the yellowness of the flame is increased. By properly selecting the adjustment of the nut 44 the coloring of the flame for realistic results is obtained.

The interceptor 33, being V-sectioned, provides an upwardly opening receptacle into which may be placed colored crystals, aromatic wood oil and various chemicals suitable for the production of pleasant odors, crackling, and other effects as desired.

While the particular artificial log fire apparatus herein shown and disclosed in detail is fully capable of attaining the objects and providing the advantages hereinbefore stated, it is to be understood that it is merely illustrative of the presently preferred embodiments of the invention and that no limitations are intended to the details of construction or design herein shown other than as defined in the appended claims.

I claim:

1. Fireplace has burner apparatus for use with log means on a grate, comprising:

(a) a combustible gas burner pipe extending in a sideward direction, the pipe having ports to pass gas in a forward direction for combustion to produce flames in a forwardly extending flame zone, (b) structure associated with the pipe including flame chute means that extends forwardly immediately beneath the forwardly extending flame zone, (c) said structure also including substantially imperforate tray plate means that extends forwardly beneath the burner pipe to support emberizing material in the path of flames forwardly of the flame chute means, thereby to glow in response to flame impingement on the emberizing material, the tray plate means to be placed on the grate, (d) said structure providing means to support log means above the flame chute means, rearwardly of and above the level of the emberizing material, so that flames rise at the forward side of the log means, and above the emberizing material, (e) the tray means extending forwardly immediately above bars defined by the grate and immediately beneath the flame chute means, and projecting forwardly beyond the flame chute means, (f) the tray means attached to the flame chute means, and the flame chute means having a connection to the pipe whereby it can be shifted relative thereto.

2. The combination of claim 1 wherein the burner pip has upper ports, and including a flame interceptor positioned closely above the tray means, to divide flames produced by combustion of gas emitted from the upper ports.

3. The combination of claim 2 including bracket means carried by the flame chute means to clamp the interceptor and the flame chute means to the burner pipe, the interceptor V-shaped in cross section, the bracket means located at the upper side of the flame chute means.

4. The combination of claim 3 including fasteners attaching the tray means to the underside of the flame chute means.

5. The combination of claim 1 including said emberizing material on the tray, proximate a forward lip defined by the tray.

6. The combination of claim 5 wherein said emberizing material comprises a mixture of rock wool and vermiculite.

7. The combination of claim 6 including said log means that is supported by said structure, and including a grate beneath and supporting said structure.

8. The combination of claim 7 wherein the tray means extends generally horizontally, immediately above said bars defined by the grate, and parallel thereto, the tray means flatly seated on said bars.

9. Fireplace gas burner apparatus for use with log means on a grate, comprising:

(a) a combustible gas burner pipe extending in a sideward direction, the pipe having ports to pass in a forward direction for combustion to produce flames in a forwardly extending flame zone, (b) structure associated with the pipe including flame chute means that extends forwardly immediately beneath the forwardly extending flame zone, (c) there being substantially imperforate tray means that extends beneath the flame chute means forwardly to support emberizing material in the path of flames forwardly of the flame chute means, thereby to glow in response to flame impingement on the emberizing material, (d) there being shoulders on one of the flame chute means and tray means providing means to support log means above the flame chute means rearwardly of and above the level of the emberizing material, so that flames rise at the forward side of the log means, and above the emberizing material, (e) the tray means attached to the flame chute means, the tray means to be flatly seated on bars defined by the grate.

10. The apparatus of claim 9 including bracket means attached to the flame chute means and to the burner pipe, the tray means flatly attached to the underside of the flame chute means.

* * * * *